US009227818B2

(12) United States Patent
Turek et al.

(10) Patent No.: US 9,227,818 B2
(45) Date of Patent: Jan. 5, 2016

(54) PASSENGER CONVEYOR WITH MOVABLE LATERAL PANEL MEMBERS

(71) Applicant: OTIS ELEVATOR COMPANY, Farmington, CT (US)

(72) Inventors: Alexander Turek, Vienna (AT); Bernward Engelke, Vienna (AT); Alois Senger, Gresten (AT); Gero Gschwendtner, Vienna (AT); Detlev Lindemeier, Vienna (AT)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 14/243,256

(22) Filed: Apr. 2, 2014

(65) Prior Publication Data

US 2014/0251753 A1 Sep. 11, 2014

Related U.S. Application Data

(63) Continuation of application No. 13/498,171, filed as application No. PCT/IB2009/007144 on Oct. 16, 2009, now Pat. No. 8,701,861.

(51) Int. Cl.

| | |
|---|---|
| ***B66B 21/00*** | (2006.01) |
| ***B66B 23/08*** | (2006.01) |
| ***B66B 21/10*** | (2006.01) |
| ***B66B 23/12*** | (2006.01) |

(52) U.S. Cl.

CPC ..... *B66B 23/08* (2013.01); *B66B 21/10* (2013.01); *B66B 23/12* (2013.01)

(58) Field of Classification Search

CPC ..... B66B 21/00; B66B 23/12; B66B 21/10; B66B 23/00

USPC ..... 198/321, 326

See application file for complete search history.

(56) References Cited

U.S. PATENT DOCUMENTS

| | | | |
|---|---|---|---|
| 5,775,477 | A | 7/1998 | Brunn |
| 6,213,278 | B1 | 4/2001 | Tanigawa |
| 6,450,316 | B1 | 9/2002 | Stuffel et al. |

(Continued)

FOREIGN PATENT DOCUMENTS

| | | | |
|---|---|---|---|
| DE | 19925399 | C2 | 11/2003 |
| JP | H11106170 | A | 4/1999 |

(Continued)

OTHER PUBLICATIONS

International Search Report and Written Opinion of the International Searching Authority for International application No. PCT/IB2009/007144 mailed Jul. 14, 2010.

(Continued)

*Primary Examiner* — James R Bidwell

(74) *Attorney, Agent, or Firm* — Carlson, Gaskey & Olds

(57) ABSTRACT

A passenger conveyor includes an endless tread band having a plurality of treads. At least one endless drive chain is driven around a first and a second turn around section by a drive. The drivetrain includes a plurality of links that are associated with drive chain rollers. A plurality of the treads are connected with the drivetrain. At least one panel member is located on a lateral side of the treads. The panel member is moveable with respect to the treads and supported to remain stationary with respect to at least one of the drive chain links. Each of the treads is associated with at least one panel member.

8 Claims, 5 Drawing Sheets

(56) References Cited

U.S. PATENT DOCUMENTS

Figure 1:
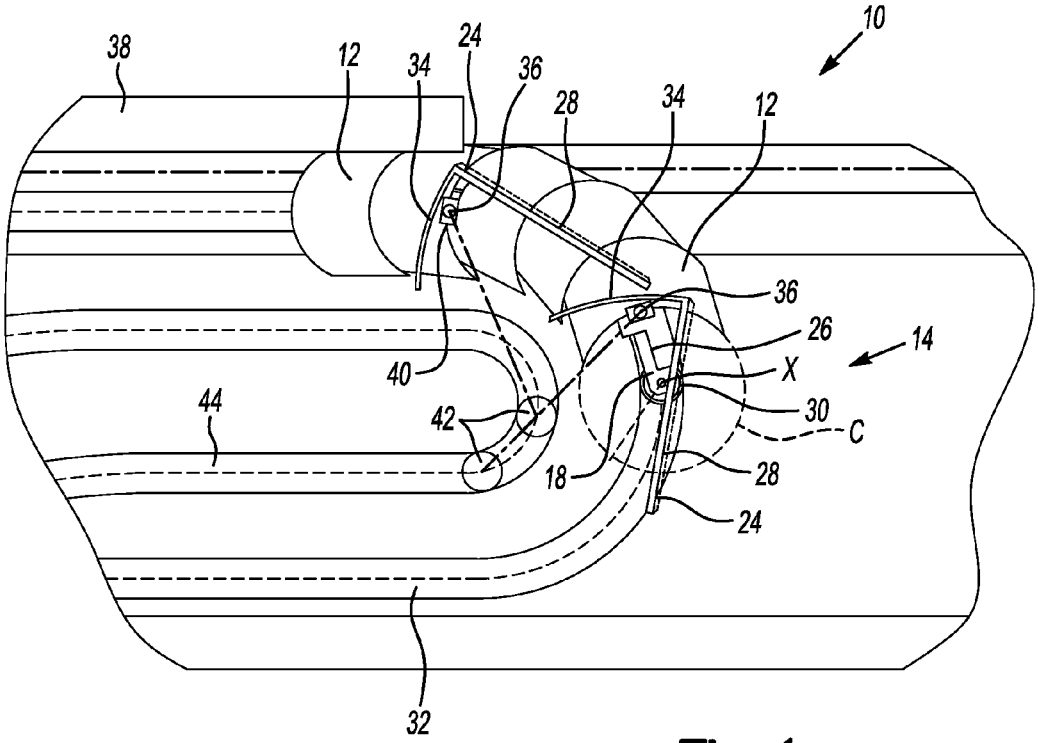

| | | | | |
|---|---|---|---|---|
| 6,640,957 | B2 | 11/2003 | Fargo et al. | |
| 7,222,713 | B2 | 5/2007 | Hauer et al. | |
| 7,401,693 | B2 | 7/2008 | Stuffel et al. | |
| 7,681,709 | B2 | 3/2010 | Vogt et al. | |
| 2003/0116403 | A1 | 6/2003 | Fargo et al. | |
| 2007/0000754 | A1 | 1/2007 | Vogt et al. | |
| 2008/0302631 | A1* | 12/2008 | Gonzalez Alemany et al. | 198/321 |
| 2013/0180822 | A1* | 7/2013 | Senger | 198/321 |

FOREIGN PATENT DOCUMENTS

| | | | |
|---|---|---|---|
| JP | 200198647 | A | 7/2000 |
| JP | 2001019325 | A | 1/2001 |
| JP | 2001019327 | A | 1/2001 |

OTHER PUBLICATIONS

Search Report for Chinese Application No. 2009080162082.7 dated Oct. 25, 2013.

* cited by examiner

PASSENGER CONVEYOR WITH MOVABLE LATERAL PANEL MEMBERS

CROSS REFERENCE TO RELATED APPLICATIONS

This is a continuation application of U.S. patent application Ser. No. 13/498,171 dated Mar. 26, 2012, which is the national stage application of International Application No. PCT/IB2009/007144 dated Oct. 16, 2009.

SUMMARY

The present invention relates to passenger conveyor.

Such passenger conveyors are e.g. escalators or moving walkways. Escalators are passenger conveyors that typically carry passengers between landings at different levels. Moving walkways are usually used to carry passengers along levels extending horizontally or with only slight inclination.

Such passenger conveyor typically includes a frame, balustrades with movable handrails, an endless transportation band or tread band (e.g. a step band or pallet band), a drive system and a transportation chain or drive chain for propelling the tread band. The drive chain travels in an endless way between sheaves or sprockets located at an upstream landing and a downstream landing, respectively. The drive chain comprises a plurality of drive chain links, each of the drive chain links having associated thereto a respective drive chain roller, consecutive of the drive chain links being connected via a respective of the drive chain rollers. The drive chain is guided by a drive chain guide fixed to the frame. The drive chain guide may e.g. interact with the drive chain rollers. The frame includes a truss section on both left and right hand sides of the frame. Each truss section has two end sections forming landings, connected by an inclined or—in case of a moving walkway—a horizontal midsection. Frequently, one of the landings houses the drive system or machine of the passenger conveyor positioned between the trusses.

The present invention particularly pertains to a passenger conveyor with an endless tread band that is composed of several transportation elements or treads (e.g. in the form of steps or pallets). A tread includes a tread surface defined by a front side, a rear side and two lateral sides, and is connected to at least one drive chain (usually termed step chain or pallet chain), e.g. via a drive chain axle and drive chain rollers. In many cases there are provided two lateral transport chains running in parallel along endless paths.

In case of a moving walkway travelling between an upstream landing and a downstream landing without significant inclination, it may be more appropriate to say that the drive chain is driven around an upstream and a downstream turnaround section. In case of an escalator the turnaround sections commonly are designated as lower and upper turnaround sections.

The drive system of a passenger conveyor typically comprises the drive chain, a drive chain drive wheel (e.g. in the form of a sprocket or toothed wheel), an axle and a drive motor. The drive chain travels a continuous, closed loop, running from one landing to the other landing, and back. The drive chain is drivably connected to the treads, e.g. via supporting respective of the treads pivotably by drive chain roller axles which support drive chain rollers of the drive chain. The drive motor drives, directly or via a further transmission, the drive sheave which is in a driving connection with the drive chain. Commonly the final drive is realized as one or a pair of chain turnaround drive wheels located in a turnaround area. The drive wheels are based on size of the treads and drive chain and are, as an example, commonly of a 750 mm diameter for most escalator systems. Around each drive wheel a drive chain is guided and driven.

There also exist passenger conveyors in which propulsion of the drive chain(s) does not take place in the vicinity of the turnaround sections, but rather in, e.g., the midsections (load section or return section). In passenger conveyors of this type, a turnaround plate or an essentially semicircular guideway may be provided instead of the chain turnaround wheel such that the drive chain rollers follow a path defined by the turnaround plate or the guideway. The drive chain rollers are reversed from the load section into the return section of the passenger conveyor in the turnaround plate or the guideway. In this respect, the term turnaround section is intended to cover all types of constructions, e.g. chain turnaround wheels, turnaround guideways or turnaround plates.

The treads of a passenger conveyor, e.g an escalator or a moving walkway, typically comprise essentially box-shaped elements with a tread surface and a front side that is exposed in the inclined region of the escalator and referred to as the"riser." In case of a moving walkway the riser is typically never exposed to the passenger. The remaining lateral, bottom and rear sides of the box, which also are never exposed to the passengers during operation of the escalator or moving walkway, may also be closed, but frequently remain open. This applies, in particular, to the underside of the tread which is situated opposite to the tread surface and to the rear side of the step. The side walls of the tread which are directed toward the drive chain are typically arranged regularly for structural reasons. In instances in which a rear wall of the box-like tread is not provided opposite to the front side, the side walls of the box which are directed toward the drive chains may have a triangular shape that is tapered toward the bottom, and the tread itself may have only a relatively small thickness in its rear region, by comparison to the thickness of the tread in the vicinity of the front side. The weight and the material requirement can be significantly reduced by these measures.

The treads are typically fastened to the drive chain(s) by means of a drive chain roller axle. The drive chain roller axle usually extends through the tread body and, in case of two drive chains arranged laterally, is connected to the drive chains at both of its free ends. The tread is customarily manufactured from a material that exhibits the required strength for carrying a passenger load and that can be easily processed, for example, a material that can be extruded such as aluminum, an aluminum alloy, or a plastic. The drive chain roller axle is manufactured from a stronger material, for example, iron or steel.

In a state of the art passenger conveyor, the individual treads typically move in a "channel" that is laterally limited by panel elements or "skirt boards." These skirt boards are rigidly arranged to the frame of the passenger conveyor, with the treads moving relative to these (stationary) skirt boards. The gap formed between the (moving) treads and the (stationary) skirt boards needs to be kept very small for safety reasons, so as to reliably ensure that no objects or clothing of passengers are pulled into this gap and become trapped therein.

The requirement to ensure a very narrow gap is associated with a high maintenance expenditure. In certain instances, it is entirely impossible to fulfill the safety requirements with respect to a narrow gap. One option for lowering this risk potential, other than with a narrow gap, consists of providing a bottom panel that is fixedly mounted to the treads and thereby moves together with the treads. Such a movable bottom panel is, e.g., described in U.S. Pat. No. 4,470,497. Such bottom panels according to the prior art have either the disadvantage that they project relatively far upward beyond the tread surface of the tread in the horizontal regions of an escalator, e.g., at the entry point and the exit point, or that they have a relatively complicated design.

DE 23 46 266 A1 discloses another approach using pivotable lateral skirt panels. Here, each step of the escalator has mounted thereto a pair of lateral skirt panels. The skirt panels are supported by the step chain roller axles by which the respective step and the steps adjacent to it are connected to the step chain. Thereby, the lateral skirt panels perform a pivot movement with respect to the respective tread surface corresponding to the rising/lowering of the step riser, as the steps travel in the inclined/horizontal sections of the endless travel path. This construction, however, requires that both the lateral skirt panels and the step chain links have the same length as the tread surfaces of the steps, and in consequence leads to large bending radii in the turnaround sections.

U.S. Pat. No. 6,450,316 B1 discloses an escalator having a construction of lateral panels formed by a combination of circular bottom panels fixedly mounted to the tread surface of each step, and movable bridge parts positioned in between two consecutive of the circular bottom panels. The movable bridge parts are associated with a corresponding link of the step chain and remain stationary thereto, as the step chain travels through different sections of the endless travel path. Each of the bridge parts has two concave interface edge portions that cooperate with the circular edge portions of adjacent bottom panels, such as to cooperate to provide a continuous barrier along each lateral side of the steps along the escalator travel path. Also this construction requires an allocation of exactly one circular bottom panel and one bridge portion at each lateral side to each step, and in consequence, similar to DE 23 46 266 A1, leads to large bending radii in the turnaround sections.

It would be beneficial to have available an alternative construction of lateral panel members providing for sufficient closure of a gap formed at lateral sides of the transporting elements of a passenger conveyor, which construction needs less space, particularly in the turnaround sections of the tread band, and is efficient to realize.

An embodiment according to a first aspect of the invention provides a passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads such as to be movable with respect to the treads, the at least one panel member being supported such as to remain stationary with respect to one of the drive chain links, wherein each of the treads is associated with a plurality of consecutive panel members.

In another embodiment according to a second aspect there is provided a passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads such as to be movable with respect to the treads, the at least one panel member being supported such as to remain stationary with respect to one of the drive chain links, wherein the at least one panel member is formed integrally with the one of the drive chain links.

In another embodiment according to a third aspect there is provided a passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads such as to be movable with respect to the treads, the at least one panel member being supported such as to remain stationary with respect to one of the drive chain links, wherein the at least one panel member comprises an arm portion and a skirt portion, the arm portion comprising a mounting end in connection with the respective drive chain link and/or its associated drive chain rollers, and a pivoting end in connection with the skirt portion, the arm portion extending essentially in direction of the drive chain link such as to displace the skirt portion from a pivoting axis thereof by a distance.

Another embodiment according to a fourth aspect provides: A passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads, such as to be movable with respect to the treads, the at least one panel member being supported such as to remain stationary with respect to one of the drive chain links, wherein the at least one panel member comprises a first interface edge portion and a second interface edge portion opposite the first interface edge portion, the first interface edge portion having a concave curvature, and the second interface edge portion having a convex curvature.

Figure 2:
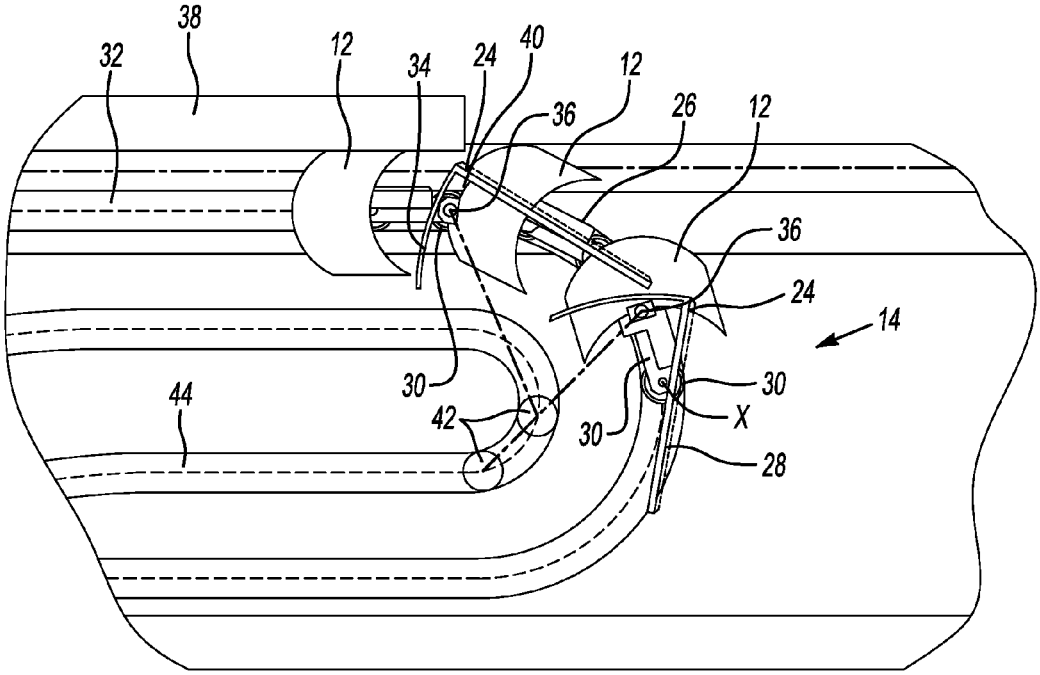
Figure 3:
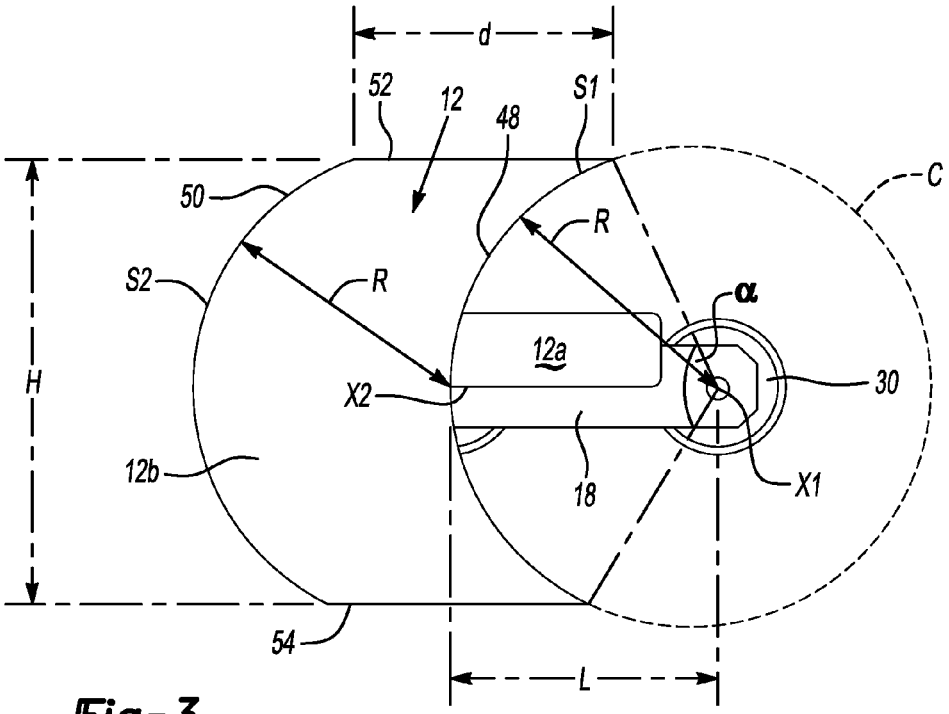
Figure 4A:
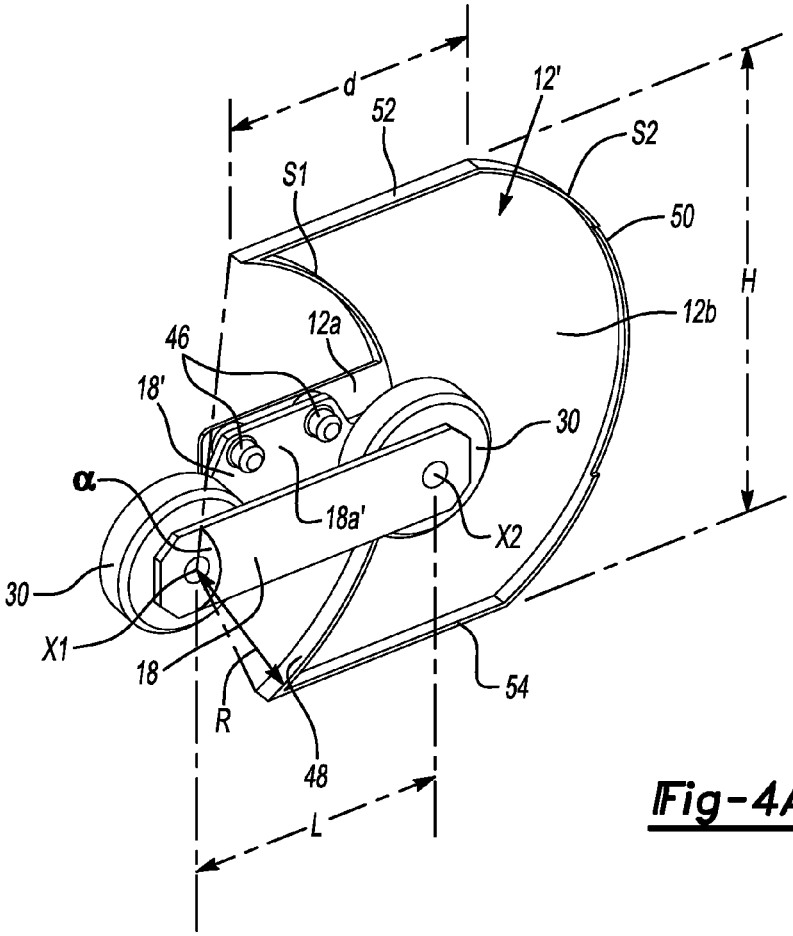
Figure 4B:
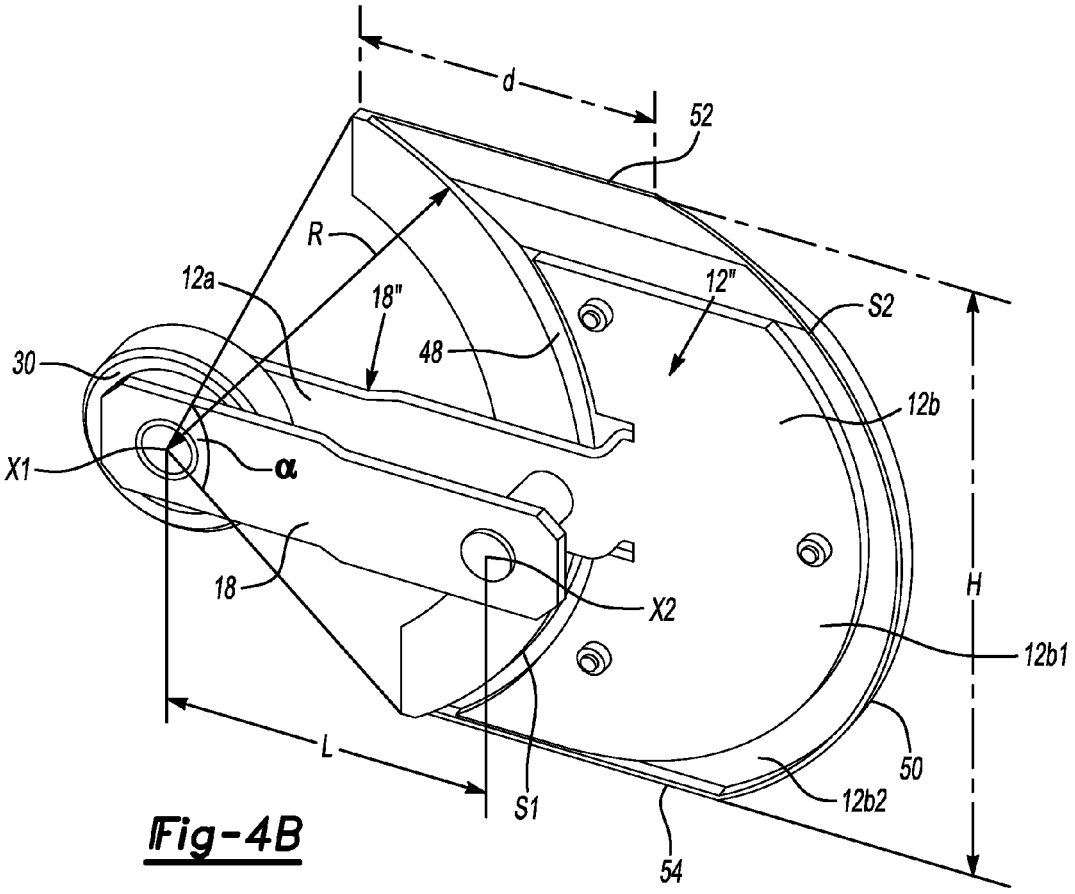
Figure 5:
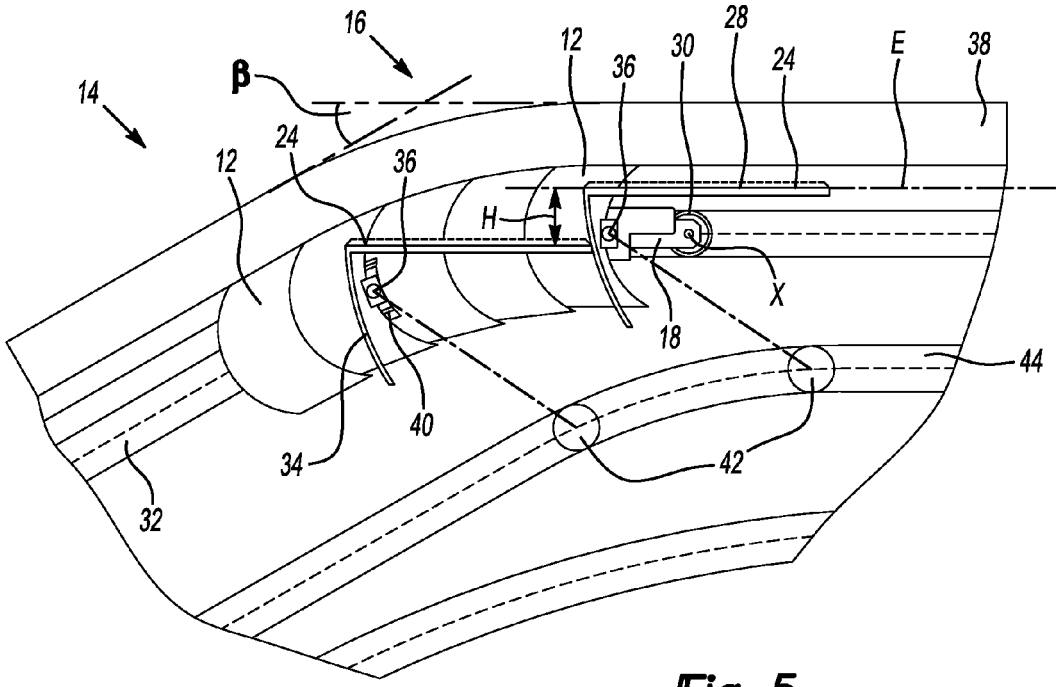
Figure 6:
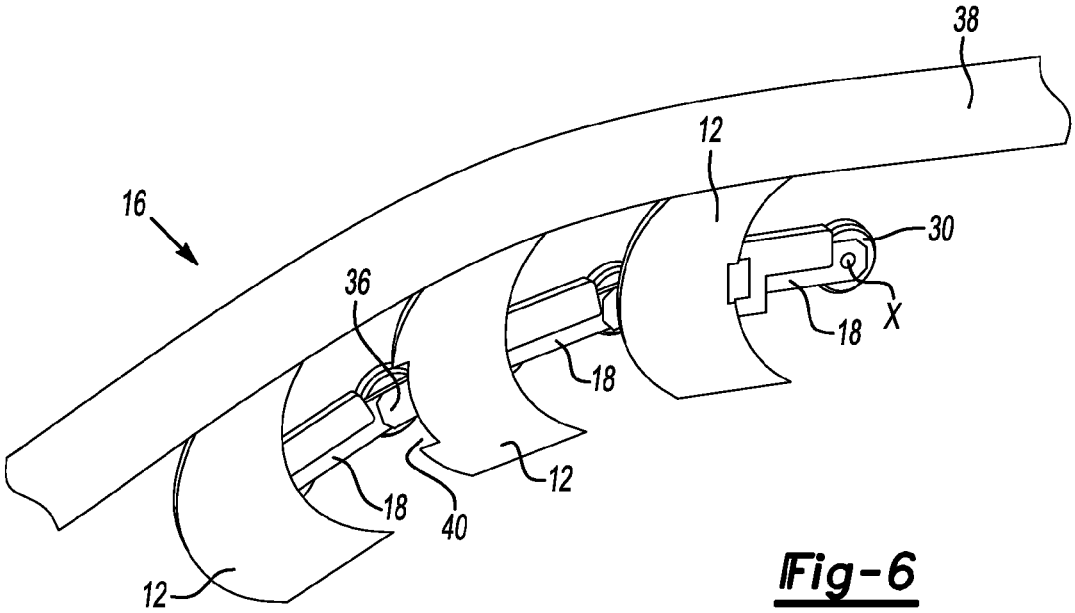
Figure 7:
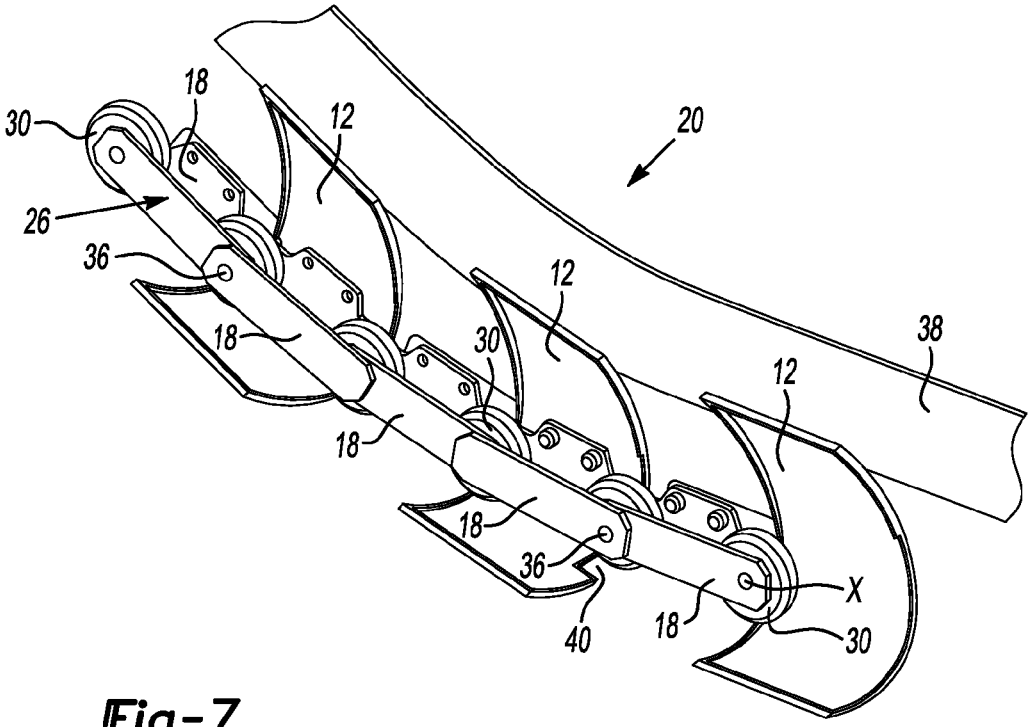
Figure 8:
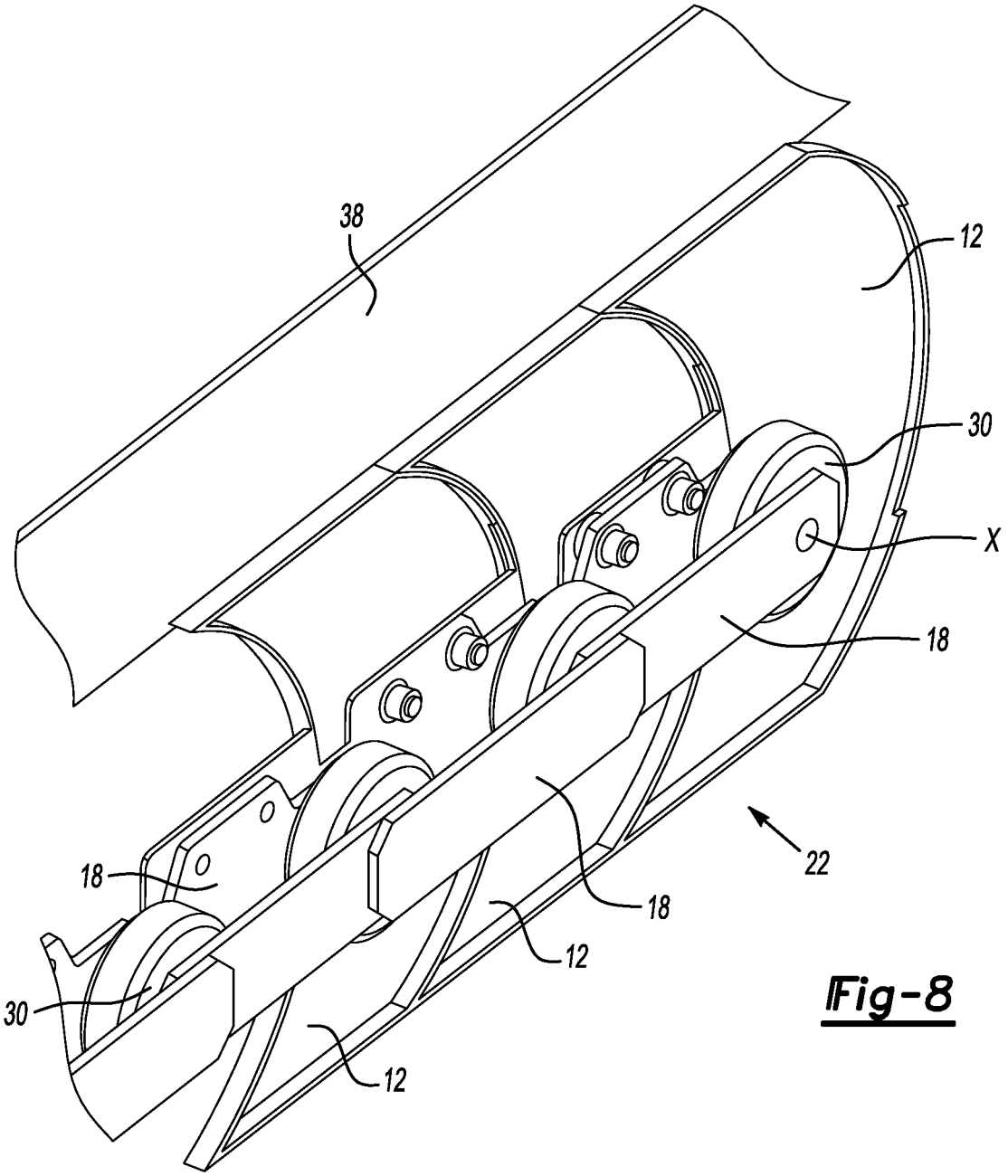

The invention, as well as a preferred embodiment of the invention, are described in more detail below with reference to the figures. The figures show:

FIG. 1: in a schematic and simplified cross section an arrangement of a plurality of consecutive lateral panel members travelling in the turnaround section of an escalator, according to an embodiment;

FIG. 2: a view similar to FIG. 1, with every other lateral panel member omitted to show how the lateral panel members are mounted to a step chain;

FIG. 3: a view of a lateral panel member attached to a step chain link, according to the embodiment;

FIG. 4*a*: the lateral panel member of FIG. 3, in a perspective view from the "back" side in FIG. 3;

FIG. 4*b*: another embodiment of a lateral panel member in a view according to FIG. 3, the lateral panel member in this embodiment being formed integrally with the associated step chain link;

FIG. 5: in a schematic and simplified cross section the arrangement of a plurality of consecutive lateral panel members travelling in the the upper transition section of an escalator, according to an embodiment;

FIG. 6: a view similar to FIG. 5, with every other lateral panel member omitted to show how the lateral panel members are mounted to a step chain;

FIG. 7: in a perspective view from the "back" side, arrangement of a plurality of consecutive lateral panel members travelling in the lower transition section of an escalator, according to an embodiment, with every other lateral panel member omitted; and FIG. 8: in a perspective view from the "back" side, arrangement of a plurality of consecutive lateral panel members travelling in a straight section of an escalator, according to an embodiment.

FIGS. 1 to 8 show various illustrations of an embodiment in the form of an escalator 10, it be understood that other embodiments, e.g. in the form of moving walkways are possible. FIGS. 1 and 2 show, in a schematic and simplified cross section along the transport direction of the escalator, an arrangement of a plurality of consecutive lateral panel members 12 in the form of lateral skirt panels 12 travelling in the turnaround section 14 of the escalator 10. FIGS. 5 to 6 show in similar form an arrangement of a plurality of consecutive lateral panel members 12 travelling in the upper transition section 16 of the escalator 10. FIGS. 7 and 8 show, in respective perspective views from the "back" side, arrangements of a plurality of consecutive lateral panel members 12 traveling in the lower transition section 20 of the escalator 10, and an arrangement of a plurality of consecutive lateral panel members 12 traveling in a straight section 22.

FIGS. 3, 4*a* and 4*b* show two different embodiments of one of the panel members 12 and its associated step chain link 18 in detail, respectively. In FIG. 4*a*, the panel member is designated by 12' and its associated step chain link is designated by 18'. In FIG. 4*b*, the panel member is designated by 12" and its associated step chain link is designated by 18". The differences between the embodiments depicted in FIGS. 4*a* and 4*b* in general have no influence on the design as depicted in the other FIGS. 1, 2, 5 to 8. Therefore, in the following description, for sake of brevity the step chain links are designated by reference sign 18, irrespective of whether they refer to step chain links 18, 18' as depicted in FIG. 4*a*, or whether they refer to step chain links 18, 18" as depicted in FIG. 4*b*. In the same way the skirt members are designated by reference sign 12, irrespective of whether they refer to skirt panels 12' as depicted in FIG. 4*a*, or whether they refer to skirt panels 12" as depicted in FIG. 4*b*. Unless explicitly referred to specific features of the embodiments of FIG. 4*a* and FIG. 4*b*, respectively, it be understood that FIGS. 1, 2 and 5 to 8 apply to both embodiments of FIGS. 4*a* and 4*b*.

Throughout all figures, corresponding elements and characteristics are identified by the same reference symbols. Therefore, explanations regarding a specific Figure generally also apply to each other Figure and are not repeated expressly with respect to all Figures.

FIGS. 1 to 8 show an escalator 10 with an endless step band that is composed of several interconnected steps (very schematically indicated at 24). The steps 24 are connected laterally to a transport or step chain 26. In FIGS. 1, 2 and 5 only one step chain 26 is visible, however it is to be understood that in the embodiment a corresponding second step chain is arranged on the opposite lateral side, such that the escalator 10 has two step chains 26 arranged on lateral sides of the steps 24, respectively. The term "laterally" connected to the steps 24 includes embodiments in which the step chains 26 are, seen in a top view, arranged laterally adjacent to the steps 24, as well as embodiments in which the step chains 26 are, seen in a top view, arranged fully or partly laterally underneath the tread surface 28 of a step 24.

Each of the step chains 26 comprises of a series of step chain links 18. The step chain links 18 have respective joints at their opposite longitudinal ends. Each two adjacent step chain links 18 are connected pivotably to one another at the respective joints (in the drawings, the pivoting axes of these joints are designated "X" or "X1","X2", respectively). Step chain rollers 30 that guide the step chain 26 along its endless path of travel between step chain guides 32 are also supported on these joints.

The escalator 10 is driven by a drive unit (not shown) that may be realized using a drive sprocket meshing with the toothing of the chain links 18 or using an endless, revolving toothed drive belt meshing with the toothing of the chain links 18.

FIG. 1 also shows that each step 24 comprises a tread surface 28 and a front side or "riser" 34. A rear side of the step 24 is arranged on the step 24 opposite to the front side 34. In the embodiment depicted each step 24 is connected to the lateral step chains 26 by way of a step chain axle 36, however other embodiments are conceivable in which only part of the steps 24 are connected to the lateral step chains 26 by way of a step chain axle 36. The step chain axle 36 is arranged in the vicinity of the front side 34 of each step 24 and coincides with the axis X of a corresponding joint of the step chain links 18 to which it is connected. Each step chain axle 36 supports on its respective free ends a pair of step chain rollers 30.

FIGS. 1 to 8 also show the lateral panel members or skirt panels 12 that move with the steps 24, as well as a stationary balustrade panel 38 that covers the top of the skirt panels 12 and continues upward. A balustrade (not shown), for example, of glass, may be arranged on the panel 38, with a (not shown) hand rail revolving on said balustrade essentially synchronously with the step band.

As is best visible in the embodiment depicted in FIGS. 1 and 5, each step 24 is associated, on each lateral side thereof, with three skirt panels 12, respectively. Each skirt panel 12 is associated with a respective one of the step chain links 18. In the embodiment depicted in FIGS. 3 and 4*a* in detail a skirt panel 12' is attached to a step chain link 18' by bolts 46. In the embodiment depicted in FIG. 4*b* a skirt panel 12" is formed integrally with an associated step chain link 18". See also FIGS. 2, 6 and 7 where every other skirt panel 12 is omitted to show how each of the skirt panels 12 extends from its associated step chain link 18. It is understood that the same arrangement applies irrespective of whether the skirt panels 12' are attached to step chain links 18' according to FIG. 4*a* or whether the step chain links 18" are integrally formed with skirt panels 12" according to FIG. 4*b*.

According to the above, in the embodiments depicted in the Figures the pitch of the step band is three times the pitch of the step chains 26, such that only each third step chain roller 30 is supported by a step chain axle 36 connecting one of the steps 24 to the step chains 26.

Other embodiments are conceivable in which another number of skirt panels 12 per step 24 may be realized, e.g. two skirt panels 12 per step 24 or four or five skirt panels 12 per step 24, as long as there is more than one skirt panel per step. The number of skirt panels per step not necessarily needs to be an integer. Also the pitch of the tread band, as defined by the distance between adjacent risers 34, may be three times the pitch of the step chain 26, as defined by the distance between the axes X of adjacent step chain rollers 30, (as is realized in the embodiment disclosed in FIGS. 1 to 8), or may be another number larger than 1. In most embodiments, one skirt panel 12 will be associated with each of the step chain links 18 and hence the pitch of the step chain 26 will be identical to the "pitch" of the skirt panels 12 as defined by the distance between two adjacent skirt panels 12.

From FIGS. 1, 2, 5, 6 and 7 it can be seen that skirt panels 12 associated with a step chain axle 36 are shaped slightly different from other skirt panels 12 in that such skirt panels 12 have a recess 40 arranged at such position that the respective step chain axle 36 may pass through the skirt panel 12. The recess 40 is arranged such as to be always below the tread surface 28 of the steps when the steps travel in the load path.

The geometry of each of the skirt panels 12 and the relation of the skirt panel 12 with respect to its associated step chain link 18 can be seen most clearly in FIGS. 3, 4*a* and 4*b*. FIGS. 3 and 4*a* show a view of a skirt panel 12' comprising an arm portion 12*a* and a skirt portion 12*b*, the skirt panel 12' being attached to a step chain link 18' by bolts 46, as shown, or by other suitable attachment means. FIG. 4*b* shows a step chain link 18" formed integrally with a skirt panel 12". It is understood that the geometrical relations between the quantities R, L, H, d and $\alpha$ as shown in FIG. 3 apply to the embodiments of FIGS. 4*a* and 4*b*, as indicated by the same reference signs R, L, H, d and $\alpha$ in these Figures.

As can be seen from FIG. 4*a*, the arm portion 12*a* of the skirt panel 12' has a mounting end fixed to an attachment lug 18*a* of the step chain link 18' by two bolts 46. The arm portion 12*a* has a pivoting end opposite to the mounting end. The pivoting end abuts the skirt portion 12*b* of skirt panel 12'. In this embodiment the arm portion 12*a* and the skirt portion 12*b* are formed integrally from a single piece, but in other embodiments these portions may be formed from separate pieces joined together (such as to form an integral part, e.g by welding, or via a detachable connection). In the embodiment of FIG. 4*a* the skirt portion 12*b* is made of one piece. In the embodiment of FIG. 4*b* the skirt portion 12*b* is formed by a skirt body portion 12*b*1 having attached thereto a cover element 12*b*2. In both embodiments the skirt portion is defined by a first interface edge 48, a second interface edge 50, an upper edge 52 and a lower edge 54. The first and second interface edges 48 and 50 are curved while the upper and lower edges 52 and 54 are straight.

The first interface edge 48 forms a circumference of a segment S1 of a circle C (indicated by dotted lines in FIGS. 1 and 3) with radius R around the pivoting axis X1 of first joint located at one end of the step chain link 18 with which the skirt panel 12 is associated (mounted to or formed integrally with). The pivoting axis X1 is co-incident with axis of first step chain roller 30. The second interface edge 50 forms part of a circumference of a segment S2 of another circle with radius R around pivoting axis X2 of second joint at the opposite end of the step chain link 18 with which the skirt panel 12 is associated (mounted to or formed integrally with). The pivoting axis X2 is coincident with the axis of second step chain roller 30. Therefore, the first interface edge 48 and the second interface edge 50 extend parallel to each other at a distance d from each other. The distance d essentially corresponds to the pitch of the step chain 26, i.e. the distance L between the axes of consecutive of the step chain rollers 30. First pivoting axis X1 of the step chain link 18 (or axis of first step chain roller 30) thereby also forms a pivoting axis of the skirt panel 12 around which the skirt portion 12*b* pivots when the step chain link 18 travels in a curved section. Since for each of the skirt panels 12 the first interface edges 48 and the second interface edges 50 have the same curvature, the first interface edge 48 of a respective skirt panel 12 can slide along the second interface edge 50 of an adjacent skirt panel 12, as the step chain links 18 to which the skirt panels 12 are mounted travel through a curved section of their travel path, e.g. travel in the turnaround sections 14 (shown in FIGS. 1 and 2) or in the transition sections 16, 20 (shown in FIGS. 5 to 7). In such curved sections the pivoting arms of adjacent skirt panels 12, as generally formed by their respective arm portions 12*a*, will not be disposed parallel to each other in a same direction, but rather will be angled to each other. The deviation angle will increase with greater curvature of the travel path. Since for each of the skirt panels 12 the distance d between the first interface edge 48 and the second interface edge 50 is equal to the pitch of the step chain 26, the space required for the arm portion 12*b* of a respective one of the skirt panels 12 can be covered completely by the skirt portion 12*b* of the adjacent skirt panel 12. Therefore, consecutive ones of the skirt panels 12 attached to consecutive step chain links 18, respectively, abut each other throughout travel of the step chain links 18 along their endless path, so that any opening left along the path of the step band between the tread surfaces 28 of the steps and a stationary balustrade panel 38 that ends in some height above the tread surfaces 28 is covered by the skirt panels 12. The sequence of consecutive skirt panels 12, as described, thereby forms a side panel element as was conventionally formed by stationary side panels extending to below the tread surfaces 28 or by "skirt boards" fixed laterally to the steps 24.

In the embodiment of FIG. 4*a*, such sequence of skirt panels 12' results from mounting to each of the step chain links 18' a respective skirt panel 12'. In the embodiment of FIG. 4*b*, such sequence of skirt panels 12" results from forming each of the step chain links 18" with an extension. In this embodiment the extension essentially includes a skirt portion 12*b* and the step chain link 18" essentially includes the arm portion 12*a*. The skirt portion 12*b* essentially extends the step chain link 18" in its longitudinal direction.

The diameter of the circles C determines the maximum height H (corresponding to the distance between the upper edge 52 and lower edge 54) that can be covered by the skirt panels 12. Typically, the skirt panels 12 will be constructed such as to make use of this maximum height as efficient as possible, such that H will be equal to or only slightly less than twice the radius R (in other words, the angle $\alpha$ of the circle segments S1 and S2 will be close to 180°). For example, the following relation holds: $1.6R \leq H \leq 2R$.

With respect to the embodiment of FIG. 4*b*, the term "formed integrally" may be understood such that the step chain link 18" and the skirt panel 12" in fact form a single piece, in other words the step chain link 18" has a shape that includes an arm portion 12*a* and a skirt portion 12*b*. Step chain links 18" of such shape can be made very efficiently from a single piece by forming such piece into a desired shape. Alternatively, it is conceivable to realize step chain links 18" of such shape by integrally joining (e.g. welding) two or more pieces together.

Also, in the embodiment of FIG. 4*b* the skirt portion 12*b* comprises a skirt portion body 12*b*1 and a cover element 12*b*2 attached to the skirt portion body 12*b*1 by bolts or by other suitable attachment means. FIG. 4*b* is a perspective view from the "back" or "rear" side of the lateral panel member, in which the skirt portion body 12*b*1 itself is, in an installed state, not visible to users while the cover element 12*b*2 attached to the skirt portion body 12*b*1 is visible to a passenger. It is understood that the cover portion 12*b*2 need not necessarily be formed from the same material as the skirt body portion 12*b*1 and may have different appearance, texture, or aesthetic features.

In the embodiment of FIG. 4*b* the interface edges 48, 50, 52 and 54 of the skirt portion 12*b* are formed by the edges of the cover element 12*b*2, as this cover element extends over the skirt portion body 12*b*2. It is noted that there may be embodiments in which such cover element only extends over part of the edges of the skirt portion body 12*b*1. In such embodiments the respective interface edge is formed by that edge extending farthest. It is further noted that there may be embodiments in which at least a part of the edges of the cover element 12*b*2 are intended to overlap with an adjacent skirt panel 12. In such embodiments typically the respective edge of the skirt portion body 12*b*1 will form the respective interface edge 48, 50, 52, 54. E.g. it is easily conceivable that the curved edges of the cover element 12*b*2 be formed from a relatively thin and preferably elastic material, such that for two adjacent skirt panels 12 the respective front and aft curved edges of the cover elements 12*b*2, which face each other, may well overlap to safely close a gap formed between the adjacent skirt panels 12. In such design, clearly the corresponding curved interface edges 52, 54 will be formed by the respective curved edges of the skirt portion bodies 12*b*1.

It is further noted that also the embodiment of FIG. 4*a* may be provided with a cover element as shown for the embodiment of FIG. 4*b* in which case the geometrical relations between the quantities R, L, H, d and $\alpha$ will have to be applied as outlined with respect to FIG. 4*b* above. Similarly, the embodiment of FIG. 4*b* may also be realized without a cover element, in which case the relationships between the quantities R, L, H, d and $\alpha$ as outlined with respect to FIG. 4*a* apply.

Each of the steps 24 further comprises a step roller 42 which is guided by a step roller guide 44 as the steps 24 travel along the endless path of the step band such as to control the correct horizontal position of the tread surfaces 28 of the steps 24 in each section of the endless path. In an embodiment the step roller 42 is connected to an attachment arm (not shown) which projects from the step 24 towards the interior of the closed loop formed by the endless step band.

In FIG. 5 the tread surfaces 28 of the steps 24 of the step band which are arranged on the uppermost end sections, adjacent the turnaround section 14, of the load path essentially lie in one plane E. However, it can be seen that a height difference h exists between the tread surfaces 28 of adjacent steps 24 in the sections of the escalator 10 which have an inclination. This height difference h will be a maximum in the midsection of the escalator having a constant inclination. The step rollers 42 are guided by the step roller guide 44 in such a way that during operation of the escalator 10 a step 24 is displaced, relative to an adjacent step 24, from a position in which the tread surfaces 28 of both steps essentially lie in one plane to a position in which the tread surfaces 28 are offset relative to one another by a height h, while nevertheless the tread surfaces 28 remain horizontal. Choosing the height H of the skirt panels 12 such as to be at least the maximum height difference h between consecutive tread surfaces 28 will allow any vertical space left open between the tread surfaces 28 and the bottom edge of the stationary balustrade panel 38 to be completely covered. Usually the height H of the skirt panels 12 will be only slightly larger than the maximum height difference h of tread surfaces 28. For an escalator having an angle of inclination $\beta$ in the midsections (see FIG. 5) the following relation can be derived: $H \geq h \cdot \cos \beta$.

The embodiments disclosed above provide a construction of lateral panel members in a passenger conveyor allowing to provide sufficient closure of a gap formed at lateral sides of the treads, by panel members that need less space, particularly in turnaround sections of the tread band, and is efficient to realize.

In an embodiment according to first aspect there is provided a passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads such as to be movable with respect to the treads, the at least one panel member being supported such as to remain stationary with respect to one of the drive chain links, wherein each of the treads is associated with a plurality of consecutive panel members.

According to this embodiment the lateral panel members may be smaller than the treads. This particularly applies to the dimension of such lateral panel members in the longitudinal direction (one may term this as "depth"), as defined by the travel direction of the passenger conveyor. As an example, for an embodiment having n lateral panel members associated to a respective tread, the depth of one of the lateral panel members is only 1/n times the depth of the respective tread (it be noted here, that n may be any number larger than one, and need not necessarily be an integer). Nevertheless the lateral panel members travel together with the treads along the endless travel path of the tread band, such that a respective one of the lateral panel members will always be associated with a same tread. Therefore, similar to conventional skirt panels laterally connected to the treads such as to be pivotable with respect thereto, a gap formed on lateral sides of the treads between the tread surfaces thereof and the lateral panel members can be made small enough to safely prevent that that objects, such as clothing are pulled into this gap and become trapped therein. Nevertheless, the smaller dimension of the lateral panel members allows a smaller minimum bending radius of the treads and drive chain in curved sections of the endless path, particularly in the turnaround sections, since interferences of the lateral panel members are suppressed efficiently.

In an embodiment the at least one panel member is attached to the one of the drive chain links. More or less conventional drive chain links can be used in this embodiment, as the only requirement to such drive chain links is that means for attaching a lateral panel member (e.g. holes for inserting respective bolts) need to be provided. Particularly the panel member may be fixedly attached to the drive chain link, and may be attached in a way as to be detachable from the drive chain link.

In another embodiment the at least one panel member is formed integrally with the one of the drive chain links. In such embodiment a sequence of consecutive panel members results from forming each or a subset of the drive chain links (e.g. any second drive chain link) with an extension, the extension essentially forming the lateral panel member in operation. The drive chain link itself, which usually is attached to the drive chain axle associated with the drive chain link and to the drive chain axle of an adjacent drive chain link, is used for providing an arm portion for the lateral panel member. "Formed integrally" may be understood such that the drive chain link and the lateral panel member associated with it form a single piece. One may also say that the drive chain link is shaped in such a way as to include both an arm portion by which it is attached to the drive chain, and a lateral panel portion which in operation extends above the tread surface of the corresponding tread. drive chain links of such shape can be made very efficiently from a single piece by forming such piece into a desired shape, e.g. by roll forming and cutting of sheet metal. Alternatively, it is conceivable to realize drive chain links of such shape by integrally joining (e.g. welding) two or more pieces together.

The lateral panel members in the above embodiments essentially extend along the direction of the longitudinal axis of the respective drive chain link associated therewith.

In view of providing an efficiently realizable construction of lateral panel members allowing sufficient closure of a gap formed at lateral sides of the transporting elements of a passenger conveyor the idea of forming the lateral members integrally with the drive chain links, is considered to be of value for itself. Therefore, an embodiment according to a second aspect provides, independent of, or in combination with, any of the other measures suggested herein above: A passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads such as to be movable with respect to the treads, the at least one panel member being supported such as to remain stationary with respect to one of the drive chain links, wherein the at least one panel member is formed integrally with the one of the drive chain links.

In a further embodiment, the at least one lateral panel member may comprise an arm portion and a skirt portion, the arm portion comprising a mounting end in connection with the respective drive chain link and/or its associated drive chain rollers, and a pivoting end in connection with the skirt portion, the arm portion extending in direction of the drive chain link, such as to displace the skirt portion from a pivoting axis thereof by a distance.

In view of providing sufficient closure of a gap formed at lateral sides of the transporting elements of a passenger conveyor by panel members that need less space, particularly in turnaround sections of the tread band, the idea mentioned just above is considered to be of value for itself. Therefore, an embodiment according to a third aspect provides, independent of, or in combination with, any of the other measures suggested herein above: A passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads, such as to be movable with respect to the treads, the at least one panel member being supported such as to remain stationary with respect to one of the drive chain links, wherein the at least one panel member comprises an arm portion and a skirt portion, the arm portion comprising a mounting end in connection with the respective drive chain link and/or its associated drive chain rollers, and a pivoting end in connection with the skirt portion, the arm portion extending in direction of the drive chain link such as to displace the skirt portion from a pivoting axis thereof by a distance.

The arm portion may, among other directions, extend at least also into the direction of the drive chain link. The mounting end may be supported indirectly (e.g. supported by the axis of drive chain rollers), such as to be stationary with respect to the drive chain link, or may be supported directly (e.g. mounted fixedly to or formed integral with the drive chain link). Particularly, one of the two drive chain rollers connecting the drive chain link to adjacent drive chain links may form a pivoting axis around which the panel member pivots.

The arm portion provides for a pivoting arm of sufficient length to allow the skirt portions of adjacent panel members to pivot about a sufficiently large pivot angle with respect to each other, without the skirt portions interfering with each other. Therefore, also the embodiment according to the second aspect allows to efficiently suppress interferences of the lateral panel members when the treads and the drive chain links travel in curved sections of their endless travel path, particularly in the turnaround sections which usually have a greatest curvature. Similar to the embodiment according to the first aspect this allows smaller minimum bending radii to be realized in the turnaround sections.

Similar to the embodiments according to the first aspect described above, the lateral panel members will always be associated with a same tread, and will travel together with the tread along the endless travel path of the tread band, but nevertheless be pivotable with respect to the tread. Therefore, the embodiment of the third aspect in the same way as the embodiments according to the first and second aspects provides the advantage that a gap formed on lateral sides of the treads between the tread surfaces thereof and the lateral panel members can be made small enough to safely prevent that that objects, such as clothing, are pulled into this gap and become trapped therein.

With respect to escalators, provision of a pivoting arm of sufficient length provides for an additional important advantage: The longer the pivoting arm is, the larger is radius of the pivoting movement of the lateral members in curved section. Since the radius of such pivoting movement restricts the maximum height of the panel members, the panel members can be made high enough to extend beyond the height difference between the tread surfaces of adjacent steps, even when travelling in the inclined midsection of an escalator.

In still a further embodiment of the passenger conveyor the at least one panel member may comprise a first interface edge portion and a second interface edge portion opposite the first interface edge portion, the first interface edge portion having a concave curvature. For a skirt portion having an edge portion with concave curvature a straight line connecting two points in the curved edge portion will usually extend outside of the skirt portion. It is conceivable that the first and second interface edge portions define the skirt portion in between.

Particularly, the second interface edge portion may have a convex curvature. For a skirt portion having a second interface edge portion with convex curvature a line connecting two points in the curved section will usually extend inside the skirt portion. In such embodiment the skirt portion may be said to have the shape of a sickle.

In view of providing sufficient closure of a gap formed at lateral sides of the transporting elements of a passenger conveyor by panel members that need less space, particularly in turnaround sections of the tread band, the idea mentioned just above is considered to be of value for itself. Therefore, an embodiment according to a fourth aspect provides, independent of, or in combination with, any of the other measures suggested herein above: A passenger conveyor, comprising an endless tread band, the endless tread band comprising a plurality of treads, at least one endless drive chain, the drive chain being driven around a first and a second turnaround section by means of a drive, the drive chain comprising a plurality of drive chain links, each of the drive chain links having associated thereto a respective drive chain roller, consecutive of the drive chain links being connected via the drive chain rollers, a plurality of the treads being connected to the drive chain, e.g. via a drive chain roller axle, and at least one panel member located on a lateral side of the treads, such as to be movable with respect to the treads, the at least one panel member being supported such as to remain stationary with respect to one of the drive chain links, wherein the at least one panel member may comprises a first interface edge portion and a second interface edge portion opposite the first interface edge portion, the first interface edge portion having a concave curvature, and the second interface edge portion having a convex curvature.

In a particular embodiment, the first and second interface edge portions may be parallel to each other in the sense that each point on the first interface edge portion has a same distance to a corresponding point on the second interface portion. Particularly, the first and second interface portions may have a same curvature. The second interface portion may be derived by displacing the first interface portion linearly about a distance d.

In a particular embodiment, the first interface edge portion may have a circular shape. Circular is meant to designate the periphery of a sector of a circle, not necessarily the periphery of a full circle. The sector may be selected such as to include an angle up to 180 degrees.

As an example, the first interface edge portion may extend along part of a circumference of a first circle with radius R around the axis of one of both drive chain rollers that are adjacent to the drive chain link to which the panel member is mounted or which is associated with the panel member. The drive chain roller axis of such drive chain roller will form a pivoting axis for the panel member. Hence, the first interface edge portion of the panel member will pivot together with the drive chain links along the periphery of such first circle with radius R. In a particular embodiment, the radius R of the first circle may be equal to the distance between adjacent drive chain rollers or, in other words, the radius R of the first circle may be equal to the pitch of drive chain.

Also the second interface edge portion may have a circular shape. Likewise to the above, a circular shape is meant to designate the periphery of a sector of a circle, not necessarily the periphery of a full circle. The sector may form a sector of up to 180 degrees. Particularly, in this embodiment, the second interface edge portion may extend along part of a circumference of a second circle around the other of the drive chain rollers adjacent to the drive chain link associated with the panel member. Thereby, the second circle will be displaced from the first circle by the pitch of the drive chain. The second circle may have the same radius R as the first circle.

Given the first interface edge portion of a first panel member associated with a first drive chain link, and the second interface edge portion of an adjacent second panel member associated with a second drive chain link have the same curvature, the first and second interface edge portions may easily slide along one another during travel of the panel members in different sections of the endless path, these sections varying from straight sections to curved sections(e.g. the transition or turnaround sections). Such sliding movement may involve a small overlap of the interface edge portions, e.g. in the form of tongue portions fitting into corresponding groove portions, or in the form of recessed portions being formed complementary to each other in thickness direction.

In a still further embodiment, the skirt portion may be defined between an upper edge portion and a lower edge portion opposite the upper edge portion. The upper and lower edge portions may be straight and parallel to each other. The upper and lower straight edge portions may interconnect the first and second interface edge portions. As an example, the upper edge portion and the lower edge portion may have a distance H to each other, where the following relation holds: $1.6\ R \leq H \leq 2R$.

In the travel path of a step in an escalator, e.g. over the course of an upwardly transporting escalator from the lower entry point to the upper exit point, the steps emerge underneath the comb plate at the entry point in an essentially horizontal position with the tread surfaces of the individual steps being essentially arranged in one plane. From this horizontal section, the travel path of the steps gradually transforms into an inclined travel path in a lower transition section and and inclined section. In an upper transition section the travel path transforms back into a horizontal movement path, until the steps ultimately disappear underneath the comb plate at the exit point. The tread surfaces of the individual steps maintain a horizontal position over this entire exposed movement path. Only the vertical distance h between the tread surfaces of adjacent steps increases from zero at start to a maximum distance in the inclined region of the travel path, and then decreases again to essentially zero.

In yet another embodiment, the passenger conveyor may be an escalator having an inclined section. The treads may form steps having a step height h when travelling in the inclined section. In this arrangement, the distance H between the upper edge portion and the lower edge portion of the panel member may be selected such as to be essentially equal to or slightly larger than the step height h of steps in the inclined section. More exactly, the following relation holds: $H \geq h \cdot \cos \beta$, with $\beta$ being the angle of inclination of the escalator, as measured with respect to the horizontal. Together with the relation $H \leq 2R$ (see above), the following relation is derived: $R \geq 0.5\ h \cdot \cos \beta$.

In yet another embodiment, the upper edge portion and the lower edge portion may each have a length d substantially equal to the distance L between successive of the drive chain rollers, i.e. may substantially be equal to the pitch of the drive chain.

Particularly, the drive chain rollers may be guided by a drive chain roller guide. Further, the drive chain roller axle by which a respective tread is supported to the drive chain(s) may be arranged in the vicinity of the front side of the tread. Each of the treads may comprise a tread surface defined by a front side, a rear side, and two lateral sides.

In a further embodiment, a plurality of first and second panel members may be arranged consecutively on lateral sides of the treads, respectively. A plurality of consecutive first panel members may be arranged on one lateral side of the treads, and a plurality of consecutive second panel members may be arranged on the opposite lateral lateral side of the treads, such that a transportation channel is formed by the treads moving in between the lateral panel members.

In a still further embodiment of the passenger conveyor a plurality of the panel members may be arranged consecutively in such a way that an open vertical space extending on a lateral side of the treads along the path of travel of the treads is covered by the sequence of panel members.

The passenger conveyor may further comprise first and second drive chains running in parallel and located on respective lateral sides of the treads, each of the first and second drive chains being driven around the first and second turnaround section.

Each of the treads may be connected to the first and second drive chains via a (common) drive chain roller axle. Each of the first and second panel members may be supported by one of the drive chain links such as to remain stationary thereto.

In a further embodiment, each of the drive chain links may be associated with one of the panel members. According to such embodiment the drive chain link supports the respective lateral panel member directly or supports the respective lateral panel member indirectly, e.g. via the drive chain rollers connecting the drive chain link with its adjacent links, in case the panel member is supported directly by such drive chain rollers.

Particularly, the distance between consecutive drive chain rollers (i.e. the pitch of the drive chain, as defined by the distances of consecutive drive chain links or drive chain rollers) may be smaller than the pitch of the treads themselves. In such arrangement, only each nth drive chain roller is connected to one of the treads via a drive chain roller axle.

In still a further embodiment in which each drive chain link and/or its associated drive chain rollers supports one of the lateral panel members, the panel members may be fixed to the drive chain link or may be formed integral therewith.

The invention claimed is:

1. A passenger conveyor, comprising
a tread band comprising a plurality of treads,
at least one drive member,
the drive member being driven around a first and a second turnaround section by a drive,
the drive member being connected with the treads, and
a plurality of panel members located on each lateral side of the treads such as to be movable with respect to the treads, the panel members being supported such as to respectively remain stationary with respect to at least one portion of the drive member, the panel members on each lateral side have the same configuration,
wherein the treads are respectively associated with at least one of the panel members.

2. The passenger conveyor according to claim 1, wherein the drive member comprises a drive chain having a plurality of links and wherein the panel members are respectively attached to respective ones of the drive chain links.

3. The passenger conveyor according to claim 2, wherein the panel members are respectively formed integrally with respective ones of the drive chain links.

4. The passenger conveyor according to claim 1, wherein a plurality of the panel members are arranged consecutively in such a way that the sequence of panel members covers an open space extending on a lateral side of the treads between the lower edges of stationary side panel elements and the tread surfaces of the treads.

5. A passenger conveyor, comprising
a tread band comprising a plurality of treads,
at least one endless drive chain,
the drive chain being driven around a first and a second turnaround section by a drive motor,
the drive chain comprising a plurality of drive chain links, a plurality of the treads being connected to the drive chain, and
at least one panel member located on a lateral side of the treads such as to be movable with respect to the treads, the at least one panel member being supported such as to remain stationary with respect to one of the drive chain links,
wherein the at least one panel member is formed integrally with the one of the drive chain links, and
wherein the at least one panel member comprises an arm portion and a skirt portion, the arm portion comprising a mounting end in connection with the respective drive chain link, and a pivoting end in connection with the skirt portion, the arm portion extending in a direction of the drive chain link such as to displace the skirt portion from a pivoting axis by a distance.

6. A passenger conveyor, comprising
a tread band comprising a plurality of treads,
at least one endless drive chain,
the drive chain being driven around a first and a second turnaround section by a drive motor,
the drive chain comprising a plurality of drive chain links, consecutive ones of the drive chain links being connected, a plurality of the treads being connected to the drive chain, and
at least one panel member located on a lateral side of the treads such as to be movable with respect to the treads, the at least one panel member being supported such as to remain stationary with respect to one of the drive chain links,
wherein the at least one panel member comprises an arm portion and a skirt portion, the arm portion comprising a mounting end in connection with the respective drive chain link, and a pivoting end in connection with the skirt portion, the arm portion extending in direction of the drive chain link such as to displace the skirt portion from a pivoting axis thereof by a distance.

7. The passenger conveyor according to claim 6, wherein the at least one panel member comprises a first interface edge portion and a second interface edge portion opposite the first interface edge portion, the first interface edge portion having a concave curvature.

8. The passenger conveyor according to claim 7, wherein the second interface edge portion has a convex curvature.

* * * * *